United States Patent [19]

Ditchfield

[11] Patent Number: 4,487,997

[45] Date of Patent: Dec. 11, 1984

[54] ELECTRIC CABLE

[75] Inventor: Neville J. Ditchfield, Chester, England

[73] Assignee: BICC Public Limited Company, London, England

[21] Appl. No.: 502,874

[22] Filed: Jun. 9, 1983

[51] Int. Cl.[3] ..... H01B 7/08

[52] U.S. Cl. ..... 174/115; 174/97; 174/117 F

[58] Field of Search ..... 174/97, 115, 117 R, 174/117 F

[56] References Cited

U.S. PATENT DOCUMENTS

| | | | |
|---|---|---|---|
| 2,066,242 | 12/1936 | Abbott | 174/117 R |
| 3,502,791 | 3/1970 | Dahlstrom | 174/115 |
| 3,800,065 | 3/1974 | Bunish et al. | 174/115 |
| 3,865,972 | 2/1975 | Norris | 174/115 |

FOREIGN PATENT DOCUMENTS

| | | | |
|---|---|---|---|
| 1525863 | 5/1968 | France | 174/97 |
| 315011 | 7/1956 | Switzerland | 174/117 R |

*Primary Examiner*—John Gonzales
*Assistant Examiner*—Morris H. Nimmo
*Attorney, Agent, or Firm*—Buell, Blenko, Ziesenheim & Beck

[57] ABSTRACT

A readily strippable electric wiring cable comprises two electrically insulated line conductors arranged substantially parallel to one another and transversely spaced apart within a surrounding extruded insulating sheath and a bare earth conductor which is loosely housed in a bore extending lengthwise within the sheath between and parallel to the insulated line conductors. Preferably, each line conductor is itself loosely housed in a separate bore in the sheath. Double insulation is provided between the earth conductor and each line conductor.

7 Claims, 2 Drawing Figures

ELECTRIC CABLE

Figure 1:
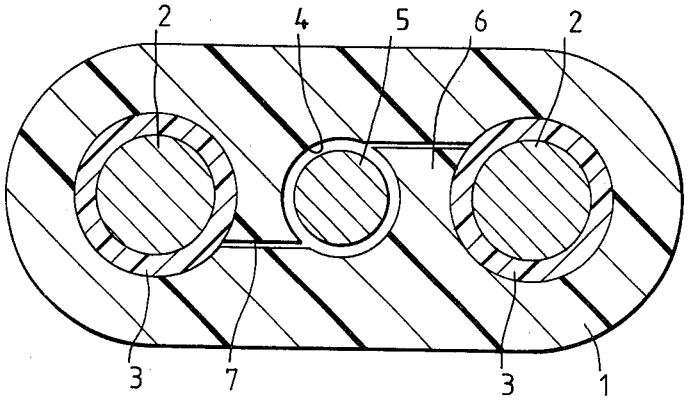

This invention relates to electric cables and is particularly concerned with electric cables for use in the wiring of buildings.

One kind of electric wiring cable which is in general use comprises two electrically insulated line conductors and a bare earth conductor arranged substantially side-by-side with their axes lying in a substantially common plane and with the earth conductor sandwiched between the two line conductors, all three conductors being encapsulated within an extruded sheath of electrically insulating material. In order to maintain the quantity of the electrically insulating material of the sheath as low as possible and thereby reduce the cost of the cable, it is common practice to arrange for the earth conductor to be in physical contact with the two insulated line conductors.

In order to reduce risk of failure of an electric wiring cable in service it has been proposed to provide a covering layer of electrically insulating material on the earth conductor before it is encapsulated in the extruded sheath so that, where the earth conductor and a line conductor are in physical contact, there are two layers of insulating material separating the actual conductors, but such a cable construction is expensive in time and material because it involves the additional manufacturing step of insulating the earth conductor and the additional insulating material employed; moreover, such a cable does not meet the relevant British Standard Specification. It would also be unpopular with users of the wiring cable because, when installing the cable and electrically connecting it to socket outlets and other fittings, insulating material would have to be stripped from end parts of the earth conductor.

An obvious alternative construction would be to separate the earth conductor and insulated line conductors physically within the extruded sheath but this solution has the disadvantage that the cable would be more expensive because of the additional insulating material employed in the extruded sheath.

It is an object of the present invention to provide a simple and inexpensive electric wiring cable in which the risk of failure of the cable in service due to a local fault in the insulation of one of the line conductors is substantially reduced.

According to the invention, the improved electric wiring cable comprises two electrically insulated line conductors which are arranged substantially parallel to one another and are transversely spaced apart within a surrounding extruded sheath of electrically insulating material, and a bare earth conductor which is loosely housed in a bore extending lengthwise within and bounded substantially wholly by material of the sheath between and substantially parallel to the insulated line conductors, the portions of the extruded elongate body separating the bore loosely housing the earth conductor from the insulated line conductors effectively being split transversely throughout the length of the cable, thereby transversely dividing each of said portions of the elongate body into two parts.

Since the bore loosely housing the earth conductor extends lengthwise within and is bounded substantially wholly by material of the sheath between the insulated line conductors, material of the extruded sheath separates the earth conductor from the insulated line conductors so that there will always be two layers of insulating material between the earth conductor and each line conductor. As a consequence, even if there is a local fault in the insulation of a line conductor, the material of the extruded sheath separating the earth conductor from this line conductor provides the necessary insulation to ensure that the cable will continue to perform to specification.

The insulated line conductors may be encapsulated within the extruded sheath with the axes of the line conductors and of the bore preferably lying in a substantially common plane, but, to limit the quantity of insulating material in the extruded sheath and thereby reduce the cost of the cable without reducing the electrical safety of the cable, each of the insulated line conductors itself may be housed in a separate bore which extends substantially parallel to the intermediate bore loosely housing the earth conductor, the portions of the extruded elongate body separating the intermediate bore loosely housing the earth conductor from the bores housing the insulated line conductors each effectively being split transversely throughout the length of the cable, thereby transversely dividing each of said portions of the elongate body into two parts. The axes of the three bores preferably lie in a substantially common plane and, preferably also, the transverse dimension of the bore loosely housing the earth conductor is less than or substantially equal to the transverse dimension of each of the bores housing the insulated line conductors. By arranging for each portion of the sheath separating the bore loosely housing the earth conductor from one of the insulated line conductors or from a bore loosely housing one of the insulated live conductors effectively to be slit transversely throughout the length of the cable, thereby transversely dividing said portion of the sheath into two parts, stripping of the sheath to expose the insulated line and bare earth conductors is facilitated. In a preferred embodiment, the transverse slit in one of said portions of the sheath is off-set to one side of the axis of the cable and the transverse slit in the other of said portions of the sheath is off-set to the opposite side of the axis of the cable. In addition to facilitating stripping of the sheath and to reducing substantially the risk that, in the event of a local fault in the insulation of a line conductor, the cable will fail in service, the improved wiring cable of the present invention has the important advantage that the quantity of material in the extruded sheath is substantially no greater than in the sheath of a wiring cable in which the earth conductor and the insulated line conductors are in physical contact.

Figure 2:
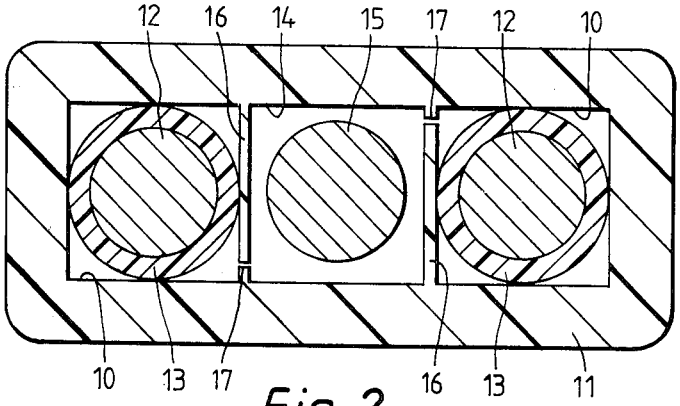

The invention is further illustrated by a description, by way of example, of two preferred forms of electric wiring cable with reference to the accompanying drawing, in which:

FIG. 1 is a transverse cross-sectional view of one preferred form of electric wiring cable, and FIG. 2 is a similar view of a second preferred form of electric wiring cable a full stop.

Referring to FIG. 1, the first preferred form of electric wiring cable comprises an extruded elongate body 1 of plastics insulating material in which are embedded two line conductors 2, each of which has a surrounding layer 3 of plastics insulation, the encapsulated line conductors being substantially parallel to one another and transversely spaced apart. A bore 4 of substantially circular cross-section extends lengthwise within the extruded body 1 between and substantially parallel to the insulated line conductors 2 with the axes of the line conductors and the axis of the bore lying in a substantially common plane, and a bare earth conductor 5 is loosely housed in the bore. Each portion 6 of the body 1 separating the bore 4 from one of the insulated line conductors 2 has a transverse slit 7 extending throughout the length of the cable and dividing this portion of the sheath into two parts. As will be seen, the transverse slits 7 are off-set on opposite sides of the axis of the cable. The transverse slits 7 facilitate stripping of the body 1 to expose the insulated line conductors 2 and earth conductor 5.

The second preferred form of electric wiring cable shown in FIG. 2 comprises an extruded elongate body 11 of plastics insulating material in which are formed three bores 10 and 14 which are arranged substantially parallel to one another with the bore 14 intermediate of the bores 10 and are transversely spaced apart with the axes of the bores lying in a substantially common plane. Each portion 16 of the body 11 separating the bore 14 from one of the bores 10 has a transverse slit 17 extending throughout the length of the cable and dividing this portion into two parts, the transverse slit 17 being off-set on opposite sides of the axis of the cable. As in the case of the electric wiring cable shown in FIG. 1, the transverse slits 17 facilitate stripping of the body 11 to expose the insulated line conductors 12 and earth conductor 15.

In each of the preferred forms of electric wiring cable shown in FIGS. 1 and 2, there will always be two layers of plastics insulating material between the earth conductor and each line conductor.

What I claim as my invention is:

1. An electric wiring cable comprising an extruded elongate body of electrically insulating material, two electrically insulated line conductors which are arranged substantially parallel to one another and are transversely spaced apart within and bounded substantially wholly by material of said extruded elongate body, a bore extending lengthwise within the elongate body between and substantially parallel to the insulated line conductors, and a bare earth conductor loosely housed in said bore, the portions of the extruded elongate body separating the bore loosely housing the earth conductor from the insulated line conductors effectively being slit transversely throughout the length of the cable, thereby transversely dividing each of said portions of the elongate body into two parts.

2. An electric wiring cable comprising an extruded elongate body of electrically insulating material, two electrically insulated line conductors which are arranged substantially parallel to one another and are transversely spaced apart and encapsulated wholly within said extruded elongate body, a bore extending lengthwise within the elongate body between and substantially parallel to the insulated line conductors with the axes of the line conductors and of the bore lying in a substantially common plane, and a bare earth conductor loosely housed in said bore, the portions of the extruded elongate body separating the bore loosely housing the earth conductor from the insulated line conductors effectively being slit transversely throughout the length of the cable, thereby transversely dividing each of said portions of the elongate body into two parts.

3. An electric wiring cable comprising an extruded body of electrically insulating material, two bores arranged substantially parallel to one another and transversely spaced apart within and bounded substantially wholly by material of said extruded elongate body; two electrically insulated line conductors, one housed in one of said bores and the other housed in the other of said bores; a bore extending lengthwise within the elongate body at a position intermediate of and substantially parallel to the bores housing the insulated line conductors; and a bare earth conductor loosely housed in said intermediate bore, the portions of the extruded elongate body separating the intermediate bore loosely housing the earth conductor from the bores housing the insulated line conductors each effectively being slit transversely throughout the length of the cable, thereby transversely dividing each of said portions of the elongate body into two parts.

4. An electric wiring cable as claimed in claim 3, wherein the axes of the three bores lie in a substantially common plane.

5. An electric wiring cable as claimed in claim 3, wherein each of the three bores is of substantially square transverse cross-sectional shape, the transverse dimension of each bore housing an insulated line conductor being equal to or slightly greater than the diameter of the insulated line conductor.

6. An electric wiring cable as claimed in claim 5, wherein the axes of the three bores lie in a substantially common plane and the transverse dimension of the bore loosely housing the earth conductor is substantially equal to the transverse dimension of each of the bores housing the insulated line conductors.

7. An electric wiring cable as claimed in claim 1, 2 or 3, wherein the transverse slit in one of said portions of the elongate body is off-set to one side of the axis of the cable and the transverse slit in the other of said portions of the elongate body is off-set to the opposite side of the axis of the cable.

* * * * *

UNITED STATES PATENT AND TRADEMARK OFFICE

CERTIFICATE OF CORRECTION

PATENT NO. : 4,487,997

DATED : December 11, 1984

INVENTOR(S) : NEVILLE J. DITCHFIELD

It is certified that error appears in the above-identified patent and that said Letters Patent is hereby corrected as shown below:

In claim 3, line 13, before "body", insert --elongate--.

Signed and Sealed this

*Twenty-first* Day of *May 1985*

[SEAL]

*Attest:*

DONALD J. QUIGG

*Attesting Officer*

*Acting Commissioner of Patents and Trademarks*